US007252368B2

(12) United States Patent
Chen et al.

(10) Patent No.: US 7,252,368 B2
(45) Date of Patent: Aug. 7, 2007

(54) FLUID INJECTOR

(75) Inventors: Wei-Lin Chen, Taipei (TW); Hung-Sheng Hu, Koahsiung (TW)

(73) Assignee: Benq Corporation, Taoyuan (TW)

( * ) Notice: Subject to any disclaimer, the term of this patent is extended or adjusted under 35 U.S.C. 154(b) by 265 days.

(21) Appl. No.: 10/982,499

(22) Filed: Nov. 5, 2004

(65) Prior Publication Data

US 2005/0093936 A1 May 5, 2005

Related U.S. Application Data

(63) Continuation-in-part of application No. 10/618,928, filed on Jul. 11, 2003, now Pat. No. 7,040,740.

(30) Foreign Application Priority Data

Nov. 5, 2003 (TW) ..... 92130899 A

(51) Int. Cl.
*B41J 2/05* (2006.01)

(52) U.S. Cl. ..... 347/63; 347/47

(58) Field of Classification Search ..... 347/20, 347/44, 47, 54, 56, 61–65, 67, 48
See application file for complete search history.

(56) References Cited

U.S. PATENT DOCUMENTS 4,908,638 A * 3/1990 Albosta et al. ..... 347/43
5,992,983 A * 11/1999 Takahashi et al. ..... 347/64
6,000,783 A * 12/1999 Takemoto et al. ..... 347/47
6,019,457 A * 2/2000 Silverbrook ..... 347/65
6,039,436 A * 3/2000 Andrews et al. ..... 347/64
6,102,530 A 8/2000 Kim et al. ..... 347/65
6,281,921 B1 * 8/2001 Sugaya et al. ..... 347/203
7,040,740 B2 * 5/2006 Hu et al. ..... 347/63
2002/0008733 A1 1/2002 Lee et al. ..... 347/48
2003/0030697 A1 2/2003 Kwon et al. ..... 347/45
2003/0081069 A1 5/2003 Kim et al. ..... 347/56
2004/0183865 A1 9/2004 Hu et al. ..... 347/63

FOREIGN PATENT DOCUMENTS

CN 1 290 211 A 4/2001
CN 1 337 316 A 2/2002
EP 1 125 743 A1 8/2001
EP 1 215 048 A2 6/2002
JP 2003 341 070 A 12/2003
TW 552200 9/2003

* cited by examiner

*Primary Examiner*—Juanita D. Stephens
(74) *Attorney, Agent, or Firm*—Ladas & Parry LLP

(57) ABSTRACT

The fluid injector includes a base, a first through hole, a fluid actuator, a passivation layer, and a thick hydrophobic film. The base includes a chamber and a surface. The first through hole communicates with the chamber, and is disposed in the base. The fluid actuator is disposed on the surface near the first through hole, and is located outside the chamber. The passivation layer is disposed on the surface. The thick hydrophobic film formed of a crosslink defines a second through hole, and is disposed on the passivation layer outside the chamber. The second through hole communicates with the first through hole.

10 Claims, 6 Drawing Sheets

FLUID INJECTOR

CROSS-REFERENCE TO RELATED APPLICATIONS

This is a continuation-in-part of application Ser. No. 10/618,928, filed on Jul. 11, 2003, now U.S. Pat. No. 7,040,740, the teachings of which are incorporated herein by reference.

BACKGROUND OF THE INVENTION

1. Field of the Invention

The invention relates to a fluid injector and a method of manufacturing the same; in particular, a fluid injector with enhanced efficiency and lifetime.

2. Description of the Related Art

Normally, fluid injectors are applied in inkjet printers, fuel injectors, and other devices. Among inkjet printers presently known and used, injection by a thermally driven bubble has been most successful due to its simplicity and relatively low cost.

FIG. 1 is a conventional monolithic fluid injector 1 as disclosed in U.S. Pat. No. 6,102,530. A structural layer 12 is formed on a silicon substrate 10. A fluid chamber 14 is formed between the silicon substrate 10 and the structural layer 12 to receive fluid 26. A first heater 20 and a second heater 22 are disposed on the structural layer 12. The first heater 20 generates a first bubble 30 in the chamber 14, and the second heater 22 generates a second bubble 32 in the chamber 14 to eject the fluid 26 from the chamber 14.

The monolithic fluid injector 1 includes a virtual valve, and is arranged in a high-density array. Furthermore, the monolithic fluid injector 1 exhibits low intermixing and low heat-loss. Additionally, there is no need to connect an additional nozzle plate to the monolithic fluid injector. As a result, the cost of the monolithic fluid injector 1 is reduced.

In the conventional monolithic fluid injector 1, however, the structural layer 12 mainly consists of silicon oxide with low stress. During manufacture, the thickness of the structural layer 12 is kept within a predetermined range; therefore, the lifetime of the entire structure of the conventional monolithic fluid injector 1 is also limited. Furthermore, since the thickness of the structural layer 12 is insufficient, the direction of injected fluid is not consistent. Additionally, after a micro fluid droplet leaves the orifice, the fluid reflows into the fluid chamber and diffuses to the surface of the fluid injector device causing overflow, and is detrimental to the next injection.

SUMMARY OF THE INVENTION

In order to address the disadvantages of the aforementioned fluid injector, the invention provides a fluid injector with enhanced efficiency and longer lifetime.

Accordingly, the invention provides a fluid injector. The fluid injector comprises a base, a first through hole, a fluid actuator, a passivation layer, and an electro-formed layer. The base includes a chamber and a surface. The first through hole communicates with the chamber, and is disposed in the base. The fluid actuator is disposed on the surface near the first through hole, and is located outside the chamber of the base. The passivation layer is disposed on the surface. The electro-formed layer defines a second through hole, and is disposed on the passivation layer outside the chamber. The second through hole communicates with the first through hole.

In a preferred embodiment, the diameter of one end, communicating with the first through hole, of the second hole is substantially larger than that of the other end of the second through hole.

The fluid actuator includes a thermal bubble generator or a piezoelectric thin film actuator. The fluid actuator is preferably a thermal bubble generator composed of a resistive layer.

In a preferred embodiment, a patterned conductive layer is formed overlying the structural layer and connects the fluid actuator to serve as a signal transmitting circuit.

It is understood that the contact angle of the electro-formed layer and water is about 90° or greater, and the electro-formed layer is preferably epoxy resin, glycidyl methacrylate, acrylic resin, acrylate or methacrylate of novolak epoxy resin, polysulfone, polyphenylene, polyether sulfone, polyimide, polyamide imide, polyarylene ether, polyphenylene sulfide, polyarylene ether ketone, phenoxy resin, polycarbonate, polyether imide, polyquinoxaline, polyquinoline, polybenzimidazole, polybenzoxazole, polybenzothiazole, or polyoxadiazole.

In this invention, a method for manufacturing a fluid injector is also provided. The method comprises the following steps. A substrate having a first surface and a second surface is provided. A patterned sacrificial layer is formed on the first surface of the substrate. A patterned structural layer is formed on the first surface of the substrate and covers the patterned sacrificial layer. A fluid actuator is disposed on the structural layer, wherein the fluid actuator is located outside the chamber. A patterned conductive layer is formed overlying the structural layer as a signal transmitting circuit. A passivation layer is formed on the passivation layer and covers the fluid actuator. A electro-formed layer is formed on the passivation layer. A fluid channel is formed in the second surface of the substrate, opposing the first surface, and exposing the sacrificial layer. The sacrificial layer is removed to form a chamber.

It is understood that the fluid actuator is covered by the electro-formed layer, and the electro-formed layer is coated on the passivation layer by spin coating or rolling, and the structural layer is a low stress silicon oxynitride or silicon nitride.

In a preferred embodiment, the method further comprises a step of forming a second through hole in the electro-formed layer. The second through hole communicates with the first through hole.

In another preferred embodiment, the method further comprises the following steps. A second through hole in the electro-formed layer is formed by gray-scale lithography such that the diameter of the upper end of the second hole is substantially larger than that of the lower end of the second through hole. Then, the passivation layer and the structural layer are sequentially etched to form a first through hole. The first through hole communicates with the chamber and the second through hole.

The present invention improves on the prior art in that a electro-formed layer is formed on the surface of the structural layer of the fluid injector device. The electro-formed layer can reinforce the structural layer of the fluid injector device and improve the interfacial characteristic of the surface of the fluid injector device. Furthermore, since the length of the injection path of the fluid can be extended by the additional thickness of the electro-formed layer, the direction of the injected fluid can be more consistent.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE INVENTION

First Embodiment

Figure 2:
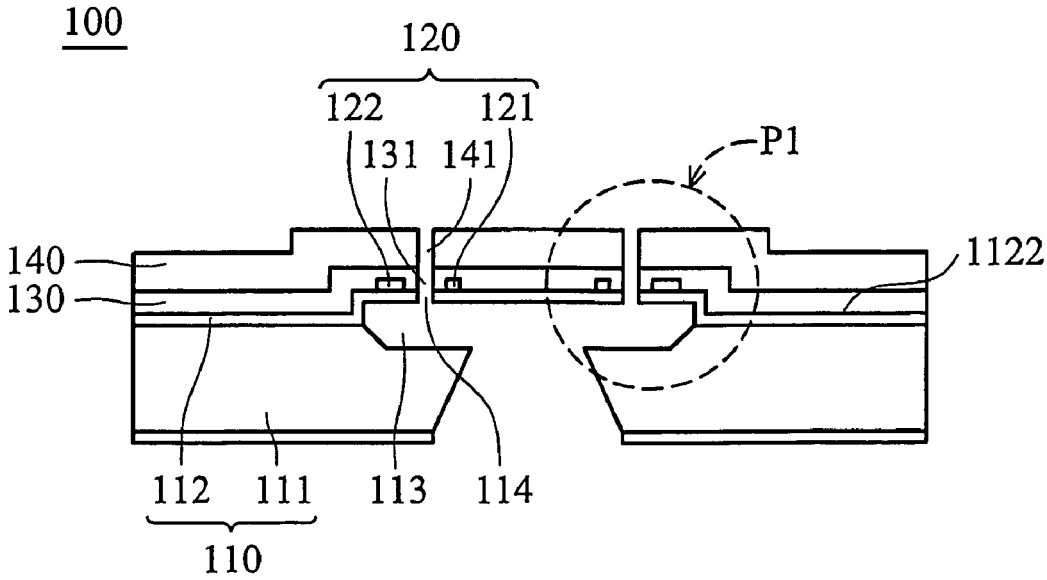
FIG. 2 is a schematic view of a fluid injector as disclosed in a first embodiment of this invention.

Referring to FIG. 2, a fluid injector 100, as disclosed in a first embodiment of this invention, is shown. In this embodiment, the fluid injector 100 comprises a base 110, a first through hole 114, a fluid actuator 120, a passivation layer 130, and a electro-formed layer 140.

The base 110 includes a silicon substrate 111 and a structural layer 112. The structural layer 112 is disposed on the silicon substrate 111. A chamber 113 is formed between the silicon substrate 111 and the structural layer 112. The first through hole 114 is formed in the structural layer 112, and communicates with the chamber 113.

Figure 1:
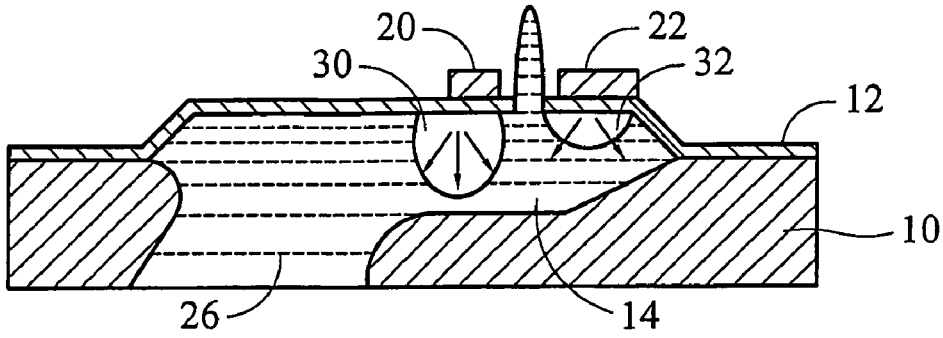
FIG. 1 (PRIOR ART)
FIG. 1 is a schematic view of a conventional monolithic fluid injector.
Figure 3A:
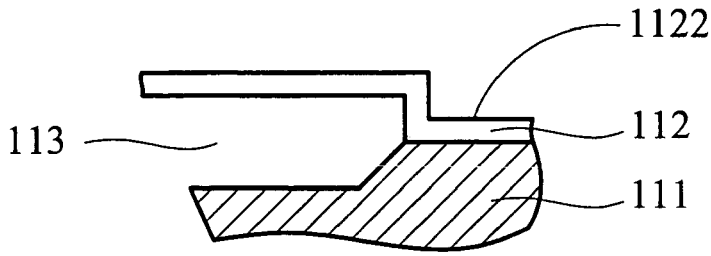
FIGS. 3*a*, FIG. 3*b*, FIG. 3*c*, FIG. 3*d*, and FIG. 3*e* are schematic views that show a method for manufacturing the fluid injector as shown in FIG. 2, wherein only a part P1 is shown.

The fluid actuator 120 is disposed on a surface 1122 of the structural layer 112 as shown in FIG. 3*a*. The fluid actuator 120 includes a thermal bubble generator or a piezoelectric thin film actuator. The fluid actuator is preferably a thermal bubble generator composed of a resistive layer. The thermal bubble generator is located near the first through hole 114 and outside the chamber 113 of the base 110. In this embodiment, the thermal bubble generator 120 includes a first heater 121 and a second heater 122. Like the heaters shown in FIG. 1, the first heater 120 generates a first bubble in the chamber 113, and the second heater 122 generates a second bubble in the chamber 113 to eject fluid from the chamber 113.

The passivation layer 130 (e.g., silicon nitride) is disposed on the surface 1122 of the structural layer 112, and includes a fifth though hole 131. The electro-formed layer 140 includes a second through hole 141, and is disposed on the passivation layer 130 outside the chamber 113. The second through hole 141 communicates with the first through hole 114 via the fifth through hole 131.

It is understood that the electro-formed layer 140 may be a material with negative photosensitivity, such as epoxy resin, glycidyl methacrylate, acrylic resin, acrylate or methacrylate of novolak epoxy resin, polysulfone, polyphenylene, polyether sulfone, polyimide, polyamide imide, polyarylene ether, polyphenylene sulfide, polyarylene ether ketone, phenoxy resin, polycarbonate, polyether imide, polyquinoxaline, polyquinoline, polybenzimidazole, polybenzoxazole, polybenzothiazole, or polyoxadiazole. Furthermore, the structural layer 112 is a low stress silicon oxynitride (SiON) or silicon nitride (SiN). The stress of the silicon oxynitride (SiON) is about 100 to 200 MPa.

The low stress silicon oxynitride (SiON) is a brittle material and is formed as a suspension structure. The suspension structure, however, must be capable of enduring thousands of thermal stress cycles. A single layer of the low stress silicon oxynitride (SiON) is not strong enough to endure the impact of the thermal stress. Accordingly, the present invention provides a electro-formed layer with predetermined thickness covering the suspension silicon oxynitride (SiON) layer. The electro-formed layer is exposed to form a cross-link structure. The electro-formed layer can effectively reinforce the suspension structure, improving operating efficiency and extending lifetime.

FIGS. 3*a* to FIG. 3*e* are schematic views showing a method for manufacturing the fluid injector 100 as shown in FIG. 2, wherein only a part P1 is shown.

A patterned sacrificial layer (not shown) is formed on a substrate 111 (e.g. a silicon wafer) having a first surface and a second surface. The sacrificial layer comprises borophosphosilicate glass (BPSG), phosphosilicate glass (PSG), or silicon oxide. The sacrificial layer is deposited using a chemical vapor deposition (CVD) or a low pressure chemical vapor deposition (LPCVD) process. In a typical processing sequence, a structural layer 112 is conformally formed on the first surface of the substrate 111 and covers the patterned sacrificial layer. The structural layer 112 comprises low stress silicon oxynitride (SiON) or silicon nitride (SiN). The structural layer 112 may be deposited using a chemical vapor deposition (CVD) or a low pressure chemical vapor deposition (LPCVD) process. A fluid channel is then formed on the second surface of the substrate 111 and exposes the sacrificial layer (not shown). The sacrificial layer (not shown) is then removed to form a fluid chamber, as shown in FIG. 3*a*.

Figure 3B:
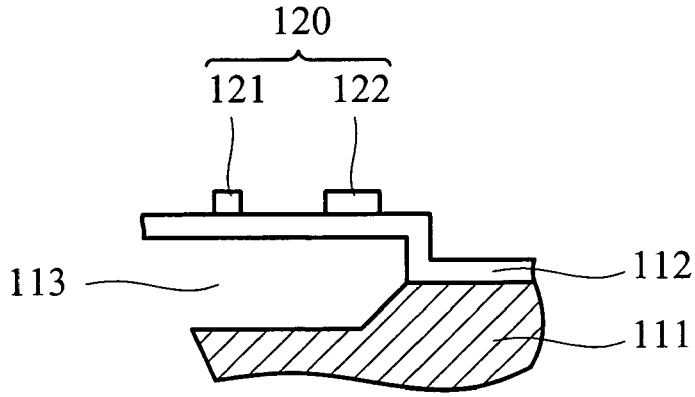

Referring to FIG. 3*b*, a fluid actuator 120 is disposed on the structural layer 112, outside the chamber 113. The fluid actuator includes a thermal bubble generator or a piezoelectric thin film actuator. The fluid actuator is preferably a thermal bubble generator composed of a resistive layer. The resistive layer comprises $HfB_2$, TaAl, TaN, or TiN. The resistive layer may be deposited using a physical vapor deposition (PVD) process, such as evaporation, sputtering, or reactive sputtering.

Figure 3C:
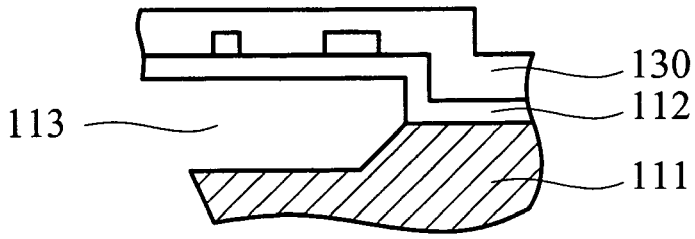
Figure 3D:
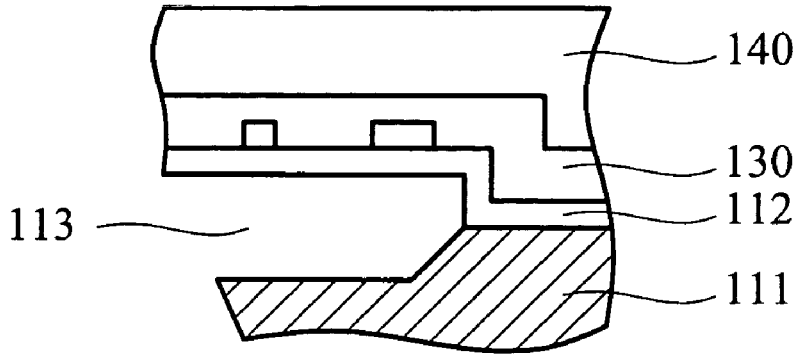
Figure 3E:
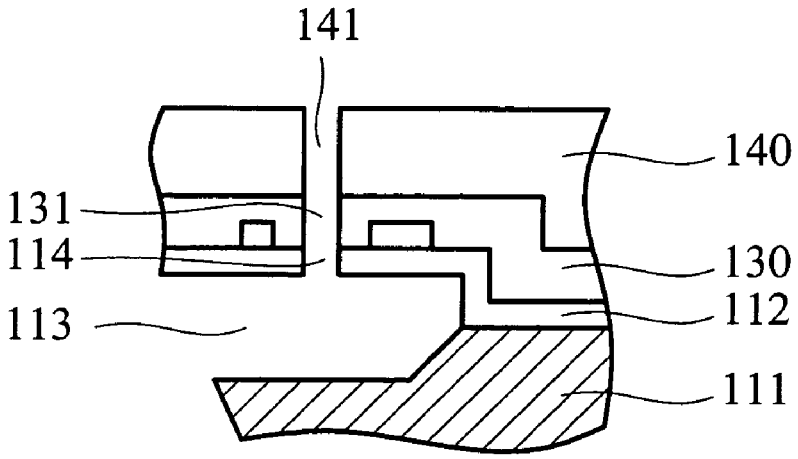

In a preferred embodiment, a patterned conductive layer (not shown), comprising Al, Cu, or alloys thereof, is formed overlying the structural layer 112 and connects the fluid actuator to serve as a signal transmitting circuit. The conductive layer may be deposited using a PVD process, such as evaporation, sputtering, or reactive sputtering. Subsequently, a passivation layer 130 is formed on the structural layer 112 as shown in FIG. 3*c*, and a electro-formed layer 140 is formed on the passivation layer 140 as shown in FIG. 3*d*. Finally, a first through hole 114 is formed on the structural layer 112, and a third through hole 131 is formed on the passivation layer 130, and a second through hole 141 is formed on the electro-formed layer 140 as shown in FIG. 3*e*. The first through hole 114, the third through hole 131, and the second through hole 141 are communicated with each other, and the first through hole 114 also communicates with the chamber 113.

It is understood that the fluid actuator 120 is covered by the electro-formed layer 140, which can be coated on the passivation layer 130 by spin coating or rolling, and the structural layer 112 is low stress silicon oxynitride (SiON) or silicon nitride (SiN).

It is also understood that the contact angle of the electro-formed layer and water is about 90° or greater, and the electro-formed layer is preferably epoxy resin, glycidyl methacrylate, acrylic resin, acrylate or methacrylate of novolak epoxy resin, polysulfone, polyphenylene, polyether sulfone, polyimide, polyamide imide, polyarylene ether, polyphenylene sulfide, polyarylene ether ketone, phenoxy resin, polycarbonate, polyether imide, polyquinoxaline, polyquinoline, polybenzimidazole, polybenzoxazole, polybenzothiazole, or polyoxadiazole.

As stated above, in the fluid injector as disclosed in this embodiment, since the electro-formed layer with a certain thickness is disposed outside the passivation layer, the structural integrity of the entire fluid injector is enhanced. Furthermore, since the electro-formed layer is provided with hydrophobic surface properties, the fluid can be constrained within the extended nozzle.

Furthermore, since the length of the injection path of the fluid can be extended by the additional thickness of the electro-formed layer, the direction of the injected fluid can be more consistent.

After a micro fluid droplet leaves the orifice, the fluid reflows into the fluid chamber and diffuses to the surface of the fluid injector device causing overflow, and is detrimental to the next injection.

Second Embodiment

Figure 4:
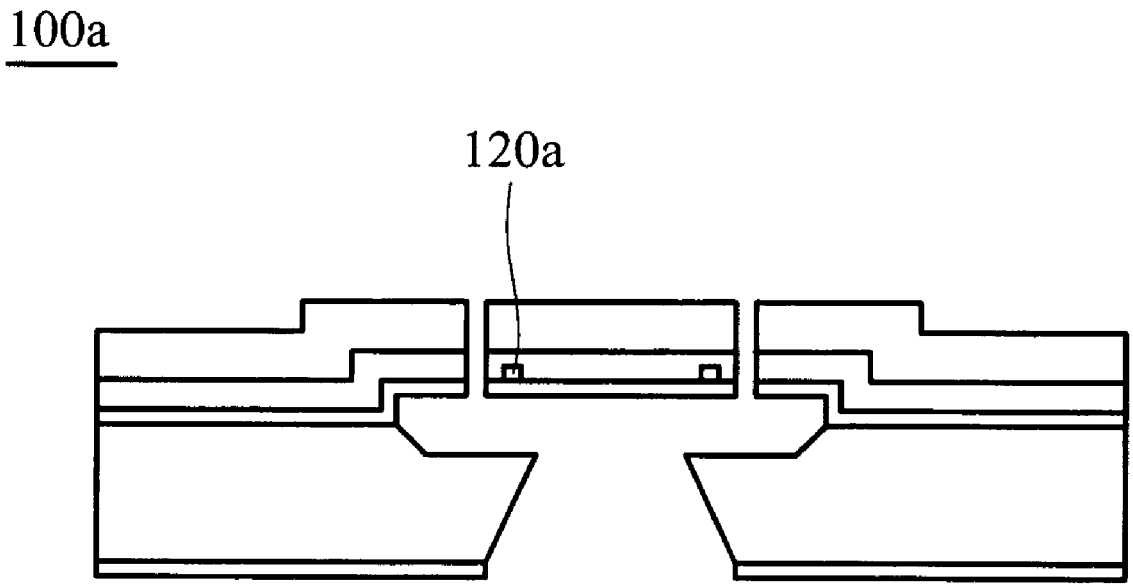
FIG. 4 is a schematic view of a fluid injector as disclosed in a second embodiment of this invention.

FIG. 4 is a schematic view of a fluid injector 100*a* as disclosed in a second embodiment of this invention. The difference between the fluid injector 100*a* of this embodiment and that of the first embodiment is that the bubble generator 120 comprises only one heater 120*a*. The other components of this embodiment are the same as those of the first embodiment; therefore, their description is omitted.

The low stress silicon oxynitride (SiON) is a brittle material and is formed as a suspension structure. However, the suspension structure must be capable of enduring thousands of thermal stress cycles. A single layer of low stress silicon oxynitride (SiON) is not strong enough to endure the impact of the thermal stress. Accordingly, the present invention provides a electro-formed layer with predetermined thickness covering the suspension silicon oxynitride (SiON). The electro-formed layer is exposed to form a cross-link structure. The electro-formed layer can effectively reinforce the suspension structure, improving the operating efficiency, and extending lifetime.

Since the fluid injector of this embodiment is also provided with the electro-formed layer, it can obtain the same effect as the first embodiment. That is, the structural integrity of the entire fluid injector can be enhanced, and the electro-formed layer is provided with hydrophobic surface properties such that the fluid can be constrained within the extended nozzle, and the direction of the injected fluid can be more consistent.

Third Embodiment

Figure 5A:
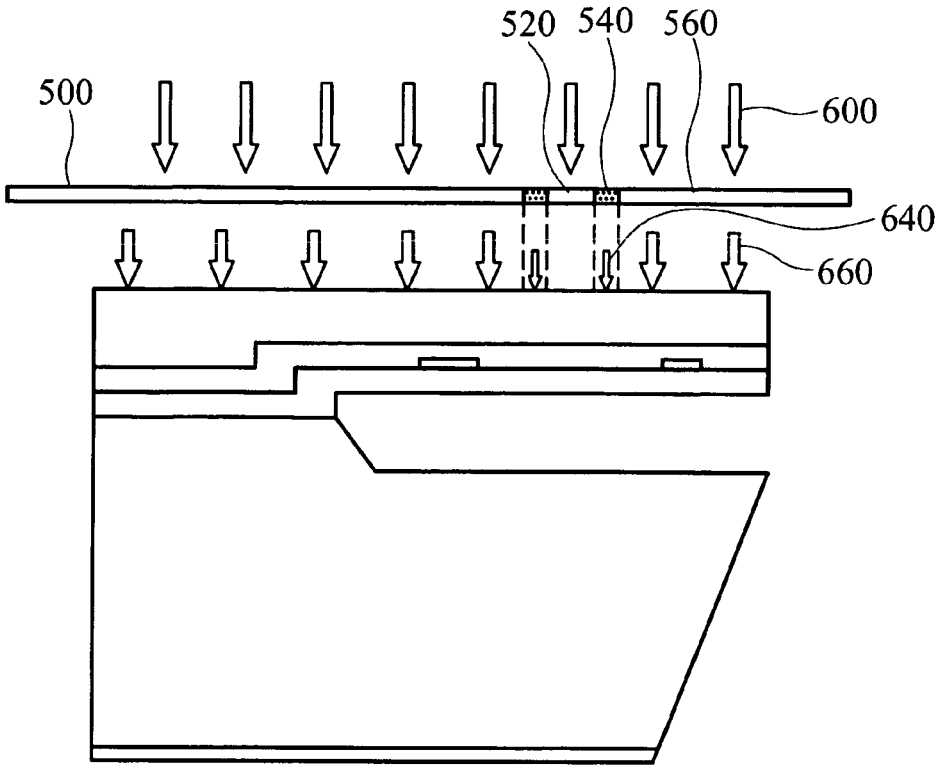
FIGS. 5*a* to 5*c* are schematic views illustrating the steps of the gray-scale lithography.
Figure 5B:
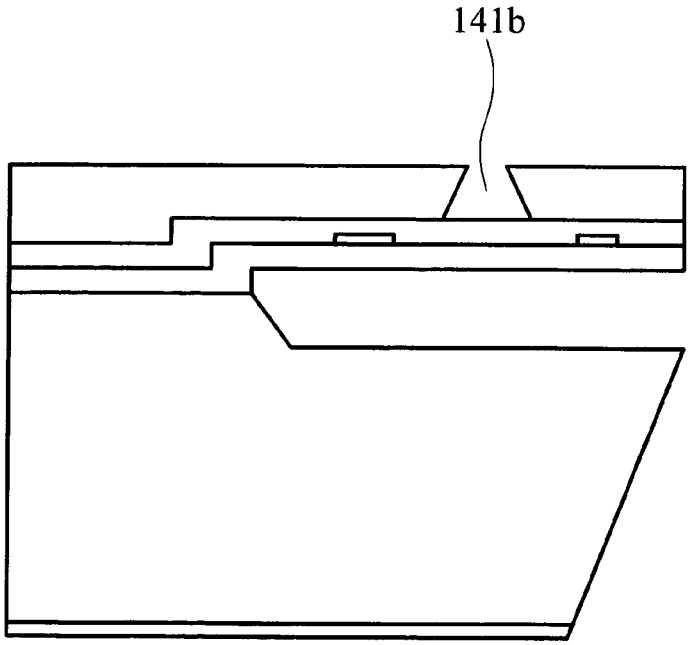
Figure 5C:
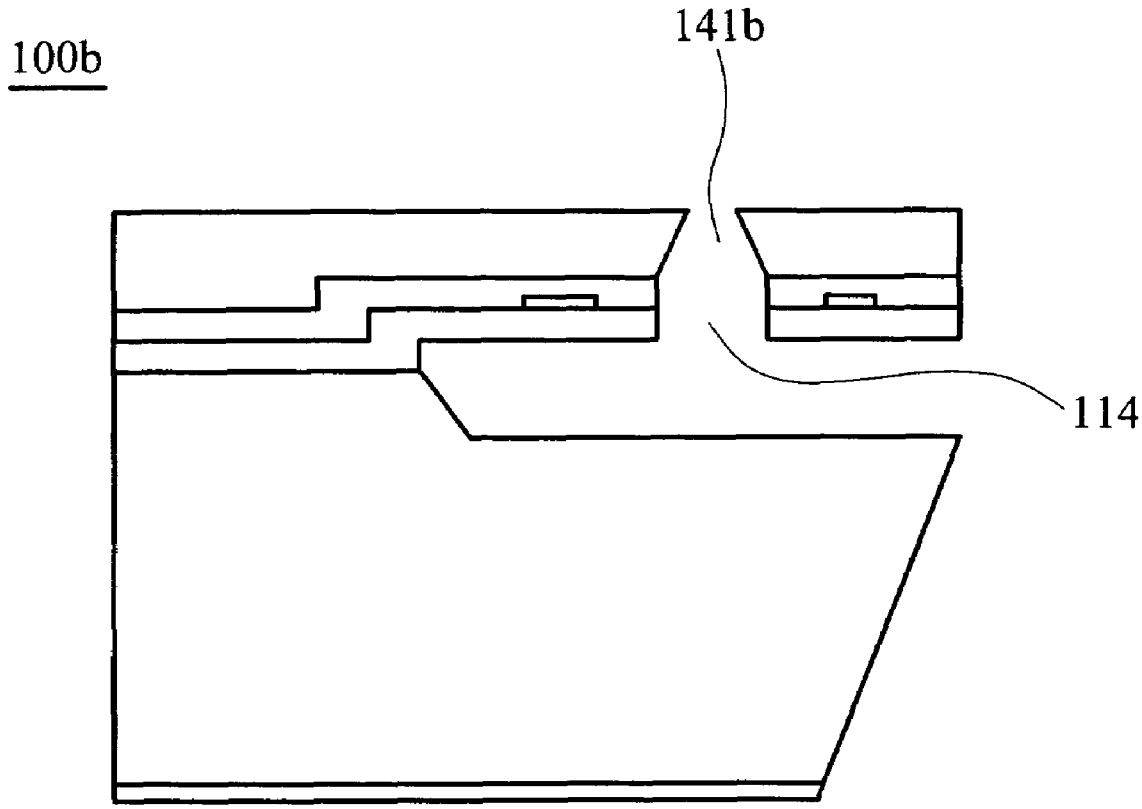

FIGS. 5*a* to 5*c* are schematic views illustrating the steps of the gray-scale lithography. The dimensions and profile of the secondary through hole 141*b* can be controlled using gray-scale lithography. A gray-scale mask modulates the intensity of ultra violet (UV) light. The modulated intensity of light will expose a photoresist of specified depths. Once the exposed photoresist is developed, a gradient height profile remains in the partially exposed photoresist.

Referring to FIG. 5*a*, the gray-scale mask 500 provides different regions with different transmittances. In the inner region 520 of the through hole, the transmittance of light intensity is 0%. The transmittance of light intensity is gradually increased to 100% in the outer region 540 and 560 of the through hole. The incident light 600 passes through the gray level mask pattern and creates a transmitted light 660 and a partially transmitted light 640. A negative photosensitive electro-formed layer is exposed by the transmitted light 660 and the partially transmitted light 640. The exposed electroformed layer is developed to obtain the shape as shown in FIG. 5*b*. As shown in FIG. 5*b*, the top portion of the photoresist 141*b* is wider than the bottom.

Referring to FIG. 5*c*, the passivation layer and the structural layer are sequentially etched to form a first through hole. The first through hole communicates with the chamber and the second through hole. In a fluid injector 100*b* as shown in FIG. 5*c*, the shape of a second through hole 141*b* is different from that of the second through hole 141 as shown in FIG. 2. The diameter of one end, communicating with the first through hole 114, of the second hole 141*b* is substantially larger than that of the other end of the second through hole 141*b*, and the direction o.

Since the fluid injector of this embodiment is also provided with the electro-formed layer, it can obtain the same effect as the first embodiment. That is, the structural integrity of the entire fluid injector can be enhanced, and the electro-formed layer is provided with hydrophobic surface properties such that the fluid can be constrained within the extended nozzle, and the direction of the injected fluid can be more consistent.

While the invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above, and all equivalents thereto.

What is claimed is:

1. A fluid injector comprising:

a base including a chamber and a surface;

a first through hole, communicating with the chamber, disposed in the base;

an actuator disposed on the surface near the first through hole outside the chamber of the base;

a passivation layer disposed on the surface; and an electro-formed layer with cross-link structure, defining a second through hole, disposed on the passivation layer outside the chamber, wherein the second through hole communicates with the first through hole.

2. The fluid injector as claimed in claim 1, wherein the base comprises:

a silicon substrate; and a structural layer disposed on the silicon substrate to form the chamber therebetween.

3. The fluid injector as claimed in claim 1, wherein the actuator includes a thermal bubble generator.

4. The fluid injector as claimed in claim 3, wherein the thermal bubble generator comprises:

a first heater, disposed on the surface outside the chamber, for generating a first bubble in the chamber; and a second heater, disposed on the surface outside the chamber, for generating a second bubble in the chamber to inject fluid in the chamber, wherein the first heater and the second heater are located at opposite sides of the first through hole.

5. The fluid injector as claimed in claim 1, wherein the actuator includes a piezoelectric generator.

6. The fluid injector as claimed in claim 1, wherein the second through hole is an inverted funnel-shape through hole.

7. The fluid injector as claimed in claim 1, wherein the contact angle of the electro-formed layer and water is about 90° or greater.

8. The fluid injector as claimed in claim 1, wherein the electro-formed layer is epoxy resin, glycidyl methacrylate, acrylic resin, acrylate or inethacrylate of novolak epoxy resin, polysulfone, polyphenylene, polyether sulfone, polyimide, polyamide imide, polyarylene ether, polyphenylene sulfide, polyarylene ether ketone, phenoxy resin, polycarbonate, polyether imide, polyquinoxaline, polyquinoline, polybenzimidazole, polybenzoxazole, polybenzothiazole, or polyoxadiazole.

9. The fluid injector as claimed in claim 1, wherein the electro-formed layer with cross-link structure is relatively thicker than the passivation layer so as to effectively reinforce the passivation layer.

10. A fluid injector comprising:

a base including a chamber and a surface;

a first through hole, communicating with the chamber, disposed in the base;

an actuator disposed on the surface near the first through hole outside the chamber of the base;

a passivation layer disposed on the surface; and a negative photosensitive electroformed layer, defining a second through hole, disposed on the passivation layer outside the chamber, wherein the second through hole communicates with the first through hole, wherein the negative photosensitive electroformed layer is formed by gray-scale lithography such that a gradient height profile remains in a partially exposed negative photosensitive electro-formed layer.

* * * * *